United States Patent [19]

Tischer

[11] Patent Number: 4,890,531

[45] Date of Patent: Jan. 2, 1990

[54] MUSICAL INSTRUMENT PICK HOLDER

[76] Inventor: Steven N. Tischer, 2330 Colonial Dr. NE., Atlanta, Ga. 30319

[21] Appl. No.: 209,531

[22] Filed: Jun. 21, 1988

[51] Int. Cl.[4] ..... G10G 7/00

[52] U.S. Cl. ..... 84/329; 84/322

[58] Field of Search ..... 84/322, 329

[56] References Cited

U.S. PATENT DOCUMENTS 3,752,029 8/1973 Watrous ..... 84/329

4,546,688 10/1985 Cuccio ..... 84/327

*Primary Examiner*—Lawrence R. Franklin

*Attorney, Agent, or Firm*—Jon R. Stark

[57] ABSTRACT

A holder for stringed instrument picks is provided in which picks may be temporarily stored by inserting them between adjacent pairs of parallel vanes, which are resiliently displaced to retain the pick. In one embodiment, the vanes may be formed by the coils of a helical spring, and the holder may be attached to the face of a musical instrument or to another convenient flat or curved surface. For more secure or longer term storage, a pick may be inserted in compression between the spring and an underlying pad. A rod may be passed through the spring coils to prevent distortion and movement of the spring.

4 Claims, 1 Drawing Sheet

FIG. 1
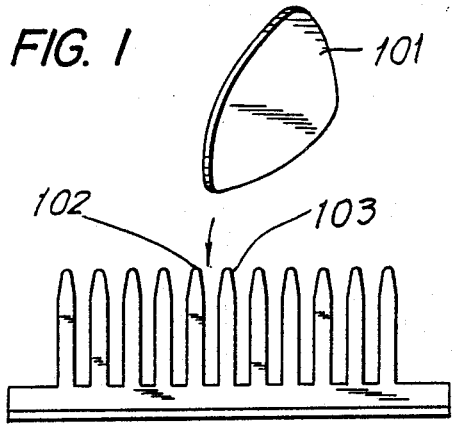
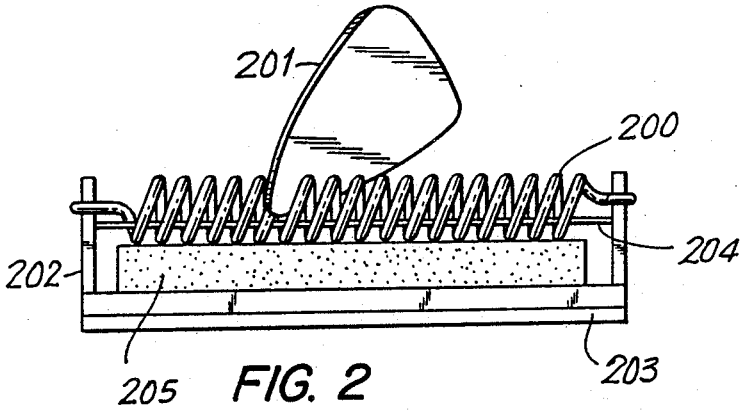
FIG. 2
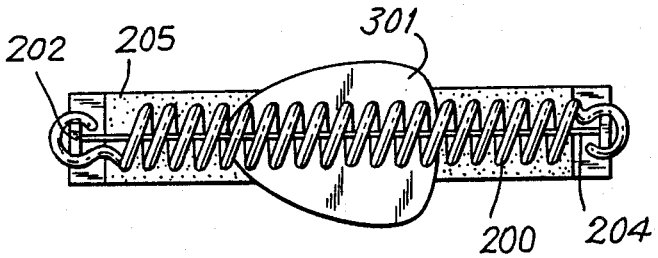
FIG. 3

MUSICAL INSTRUMENT PICK HOLDER

BACKGROUND OF THE INVENTION

1. Field of the Invention

This invention relates generally to the field of accessories for stringed musical instruments, and in particular to devices for temporary or long term storage of plectrums.

2. Description of the Prior Art

Many stringed musical instruments, such as guitars, bass guitars, mandolins, and banjos, may be played by plucking the strings with an implement properly known as a plectrum. In informal parlance, musicians commonly refer to a plectrum as a "pick", so that term will be used for simplicity and clarity hereafter.

The individual tastes and preferences of musicians have led to a wide variety of shapes, sizes, and designs of picks in ordinary use, but most picks share a few common characteristics. Picks are usually flat, thin pieces of a flexible material with a surface large enough to grasp between the thumb and finger and a pointed shape for contact with the strings of the instrument. The size, shape, and flexibility of the pick are chosen to suit the comfort of the musician and to produce tonal response as desired for the music to be played. Depending upon the instrument, the musical piece to be played, and the particular sound desired, a musician may select from a range of favorite picks, or may forego the use of a pick altogether and use fingers alone to pluck the strings.

A fundamental difficulty with picks arises from their size. Because picks are rarely much larger than a coin, they are very easy to drop, lose, or misplace, and it can be a real nuisance to a musician to keep track of them during and between performances. It can be especially annoying if a pick is to be used intermittently during a performance, because there is no convenient way to stow it while it is not in use, so that it will be readily accessible when needed. No satisfactory solution to this problem has been provided by the prior art.

In the past, musicians had few options for pick storage. Transport cases for instruments such as guitars often contained a simple box in which picks could be placed, but this was of little help. A guitar case is a cumbersome thing which cannot be kept close at hand during a performance without cluttering the stage. Furthermore, a simple box does not keep a preselected pick handy for use, and rummaging around in a box on a darkened stage to locate a pick is extremely awkward. Fumbling in one's pockets for a pick is similarly awkward and unprofessional in appearance.

Some musicians have resorted to wedging a pick through the strings of the instrument itself, in much the same manner that a weaving shuttle is passed over and under strands of thread. While a pick may be placed on an instrument in that fashion if the pick size, string tension, and string spacing permit, the presence of the pick may interfere with normal string motion during play, the forces of the strings may warp the pick, and access may be less quick and convenient than is desirable.

A need exists for a convenient pick holder which will permit rapid, easy access to and replacement of a pick under the conditions imposed by live stage performance, and secure storage during the inevitable travel between engagements.

SUMMARY OF THE INVENTION

In accordance with the preferred embodiments of the present invention, a musical instrument pick holder includes a plurality of substantially parallel vanes which are positioned so that a pick may be placed between an adjacent pair of vanes. The vanes are displaced apart as the pick is inserted, providing a resilient force to retain the pick. The pick holder may be placed directly on the surface of a musical instrument, or upon another convenient surface, such as an amplifier or microphone stand, and picks may be easily inserted and removed as needed.

In one embodiment, the vanes are formed by the coils of a helical spring, so that insertion of a pick between two coils will retain the pick for ready access. The spring may be held at the desired state of tension by attachment to a bracket, which in turn, may be attached to any handy flat or curved surface. The pick holder may also be provided with a rod, attached to the bracket and passing through the spring, which limits distortion and displacement of the spring.

One preferred configuration includes a pad, mounted between the rod and the bracket. A pick may then be slipped between the pad and the coils for longer term or more secure storage, as may be desired for transport.

DESCRIPTION OF THE DRAWINGS

FIG. 1 is a side view of a pick holder in accordance with a preferred embodiment of the invention.

FIG. 2 is a side view of another embodiment, showing a pick inserted for temporary storage.

FIG. 3 is a top view of the pick holder of FIG. 2, showing a pick inserted for more secure or longer term storage.

DESCRIPTION OF THE PREFERRED EMBODIMENTS

In the course of development of the present invention, it has been found that a convenient way to provide temporary and handy storage of a pick is to provide a set of substantially parallel vanes. If the vanes are placed somewhat closer together than the thickness of a typical pick, and are made flexible or are resiliently mounted, then insertion of a pick between adjacent vanes will displace those vanes away from each other to accommodate the pick. The resilient forces thus will squeeze the pick between the vanes, and retain the pick so that it may be held in a convenient location and may be easily removed by simply pulling it from between the vanes.

Several methods of producing such vanes are possible. For example, the vanes may be molded plastic fins or blades which are all attached to a common base, much like the teeth of a plastic comb, as depicted in FIG. 1. Flexibility of the fins will permit a pick 101 to be slipped between any two adjacent fins 102, 103 while those fins are spread outward by the thickness of the pick.

Another particularly convenient approach may be understood by reference to FIG. 2. There, a set of vanes is formed by the coils of a helical spring 200. Each individual coil serves as one vane, and a pick 201 may be inserted between adjacent coils. The spreading of the coils by the pick causes sufficient compression on the pick to retain it, yet permits it to be easily withdrawn for use. In this case, the vanes are not solid fins or blades, but the edge contour of a coil will be understood to define a vane location and to serve the purpose of exerting a retaining force against the pick.

A bracket 202 may be used to hold the spring at its ends. The force on an inserted pick may then be easily controlled by the degree to which the spring is stretched in the bracket, which determines the spacing between coils when no pick is inserted. The choice of materials for the bracket is not critical so long as the bracket will withstand tension in the spring when the pick holder is installed and used.

The diameter of the helix of the spring is also not critical, but should ordinarily be chosen to provide an adequate contact area with the pick for security, and yet leave enough of the pick protruding to permit it to be grasped easily. The length of the spring may be chosen as a compromise for the number of picks which may be inserted, the cost of the materials required, the aesthetic visual impact when attached to an instrument, and the size of the space in which the pick holder will be placed. The spring may be made of metal, plastic, or other material which provides adequate resilience to retain a pick. The surface of the material in the coils should be smooth enough to avoid unwanted scarring or nicking of plastic picks.

The pick holder may be attached to body of an electric guitar, to an amplifier, to a microphone stand, or to any other convenient surface as desired by the musician. To facilitate such attachment, an adhesive layer 203 is shown on the underside of the bracket. Attachment by an adhesive such as double-stick tape is suggested, since no holes need be made in the body of a musical instrument, and adequate security for most applications will be achieved. Attachment by other known methods such as screws or rivets will also suffice.

The embodiments of the drawings are depicted as straight structures having flat bottoms, which would be suitable for attachment to flat surfaces, for ease of illustration. In some circumstances, it may desirable to bend or curve the entire assembly. For example, the pick holder may be made to conform to the cylindrical shaft of a microphone stand, so that it wraps around the shaft. As long as the spacing between vanes is kept close enough to retain a pick, the same basic structures may be used in either straight or curved applications. Indeed, the bracket of FIG. 2 may be made of conformable material which will hold a desired shape against the tension of the spring when adhesive layer 203 is pressed against a curved surface.

Also shown in FIG. 2 is a rod 204 which passes through the coils of spring 200 and is attached at its ends to the bracket 202. As shown, this rod runs parallel to the axis of the helix of the helical spring, but is displaced downward toward the bottoms of the coils. Inclusion of such a rod or equivalent restraint prevents spring 200 from distorting or moving about when picks are being inserted and withdrawn from between the coils. If desired, motion and distortion may otherwise be reduced by bonding the bottom of several coils to the bracket, but use of the rod provides additional advantages which will be made apparent below. The rod may be fixed to the bracket by any convenient method.

A compressible pad 205 may be inserted between the bracket 202 and the rod 204. In combination with the rod 204, this pad will further reduce motion of the spring and provide stability while picks are being inserted. The pad may be made of a dense foam plastic glued to the bracket, and its thickness may be chosen so that the lower part of the coils will be held against it by rod 204.

An additional benefit of the use of rod 204 and pad 205 may be appreciated by referring to FIG. 3. For more secure or longer term storage of a pick, as for example, while transporting equipment between performances, a pick may be inserted between the rod and the pad. Note that as shown in FIG. 3, the orientation of the pick 301 with respect to the spring is approximately ninety degrees from that shown for the pick in FIG. 2. Instead of wedging a pick between adjacent coils of the spring, the flat side of the pick is turned parallel to the axis of the spring, and the pick is placed in contact with the bottom of several coils. A pick thus positioned is unlikely to be accidentally dislodged, yet is still easily accessible when needed.

The upper surface of pad 205 may be made of a low friction material, to aid in slipping a pick in and out, if desired. The compressibility of pad 205 required for easy insertion and extraction of a pick will depend upon the ease with which rod 204 may be flexed. An extremely rigid rod would require more compressibility, while a very flexible rod would permit a pad with negligible compressibility.

The foregoing description is provided to illustrate the present invention, but not to define its limits, which are set forth by the appended claims.

I claim:

1. A musical instrument pick holder comprising:

attachment means for mounting on a surface, including a bracket having two spaced-apart ends, and including means for mounting the bracket on the surface;

a plurality of substantially parallel vanes connected to the attachment means, each of said vanes being delimited by a coil of a helical spring, adjacent vanes being resiliently displaceable by insertion of a pick therebetween, each end of the bracket being connected to the helical spring; and rod means for limiting distortion and displacement of the helical spring, said rod means passing through the coils of the helical spring substantially parallel to the axis of the helix of the helical spring, and connected to the bracket.

2. A musical instrument pick holder as in claim 1, further comprising a pad attached to the bracket between the bracket and the rod means to permit a pick to be securely held between the pad and the coils of the helical spring.

3. A musical instrument pick holder as in claim 1 wherein said helical spring is metal.

4. A musical instrument pick holder as in claim 1 wherein said helical spring is formed of a plastic material.

* * * * *